US010584477B2

(12) United States Patent
Richards

(10) Patent No.: US 10,584,477 B2
(45) **Date of Patent: *Mar. 10, 2020**

(54) MOMENT-RESISTING FRAMES AND KITS FOR ASSEMBLING THE SAME

(71) Applicant: DURAFUSE FRAMES, LLC, West Jordan, UT (US)

(72) Inventor: Paul William Richards, Orem, UT (US)

(73) Assignee: DURAFUSE FRAMES, LLC, West Jordan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/394,665

(22) Filed: Apr. 25, 2019

(65) Prior Publication Data

US 2019/0249410 A1 Aug. 15, 2019

Related U.S. Application Data

(63) Continuation of application No. 15/500,991, filed as application No. PCT/US2015/047006 on Aug. 26, 2015, now Pat. No. 10,316,507.

(Continued)

(51) Int. Cl.
*E04C 3/00* (2006.01)
*E04B 1/24* (2006.01)

(Continued)

(52) U.S. Cl.
CPC ..... *E04B 1/2403* (2013.01); *E04B 1/98* (2013.01); *E04G 23/0218* (2013.01);

(Continued)

(58) Field of Classification Search
CPC ... E04C 5/162; E04C 3/32; E04C 3/30; E04B 1/2403; E04B 2001/2415;

(Continued)

(56) References Cited

U.S. PATENT DOCUMENTS 3,977,801 A ‡ 8/1976 Murphy ..... E04B 1/2403 248/188
4,047,341 A ‡ 9/1977 Bernardi ..... E04B 1/2403 403/230

(Continued)

FOREIGN PATENT DOCUMENTS

JP 2000144901 A ‡ 5/2000
JP 2000144901 A 5/2000

(Continued)

OTHER PUBLICATIONS

Notice of Allowance for U.S. Appl. No. 15/516,834 dated Mar. 8, 2019.‡

(Continued)

*Primary Examiner* — Chi Q Nguyen
(74) *Attorney, Agent, or Firm* — Dorsey & Whitney LLP

(57) ABSTRACT

Various embodiments disclosed herein relate to moment-resisting frames, kits for assembling such moment-resisting frames, and methods of repairing such moment-resisting frames. In an embodiment, a moment-resisting frame includes a beam connected to a column using a moment-resisting connection. The moment-resisting connection may include at least one exterior doubler plate ("EDP") that is connected to the column and two or more connectors that are connected to both the beam and the EDP. In some embodiments, the moment-resisting frame may require less welding than conventional beam-to-column connections. Additionally or alternatively, such a moment-resisting frame may eliminate the need for components typically used in conventional beam-to-column connections (e.g., continuity plates).

20 Claims, 12 Drawing Sheets

Related U.S. Application Data

(60) Provisional application No. 62/044,738, filed on Sep. 2, 2014.

(51) Int. Cl.
*E04H 9/02* (2006.01)
*E04B 1/98* (2006.01)
*E04G 23/02* (2006.01)

(52) U.S. Cl.
CPC ..... *E04H 9/024* (2013.01); *E04B 2001/2415* (2013.01); *E04B 2001/2418* (2013.01); *E04B 2001/2448* (2013.01); *E04B 2001/2451* (2013.01); *E04B 2103/06* (2013.01)

(58) Field of Classification Search
CPC ..... E04B 2001/2418; E04B 2001/2439; E04B 2001/2448; E04B 2001/2451; E04B 2001/2445; E04H 9/024
USPC ..... 52/831, 854, 653.1, 846, 837, 745.17, 52/848, 655.1, 650.1, 167.3, 236.6, 283
See application file for complete search history.

(56) References Cited

U.S. PATENT DOCUMENTS 5,148,642 A 9/1992 Plumier et al.
5,595,040 A ‡ 1/1997 Chen ..... E04B 1/2403 52/167.1
5,660,017 A ‡ 8/1997 Houghton
6,138,427 A ‡ 10/2000 Houghton
6,237,303 B1 ‡ 5/2001 Allen et al. ..... E04B 1/2403 52/653.1
6,591,573 B2 ‡ 7/2003 Houghton ..... E04B 1/2403 52/236.3
7,047,695 B2 ‡ 5/2006 Allen et al. ..... E04B 1/2403 52/120
7,762,038 B2 ‡ 7/2010 Ceba et al. ..... E04B 1/2403 52/653.1
7,874,120 B2 ‡ 1/2011 Ohata et al. ..... E04B 1/2403 52/653.1
8,800,239 B2 * 8/2014 Yang ..... E04B 1/24 403/218
9,091,065 B2 * 7/2015 Tran ..... E04C 5/162
9,200,442 B2 12/2015 Richards
9,506,239 B2 * 11/2016 Houghton ..... E04B 1/2403
10,316,507 B2 * 6/2019 Richards ..... E04B 1/2403
2002/0184836 A1 ‡ 12/2002 Takeuchi et al.
2003/0208985 A1 ‡ 11/2003 Allen et al. ..... E04B 1/2403 52/653.1
2004/0050013 A1 * 3/2004 Okada ..... E04B 1/2403 52/848
2005/0204684 A1 ‡ 9/2005 Houghton
2006/0144006 A1 ‡ 7/2006 Suzuki et al.
2006/0265992 A1 ‡ 11/2006 Hiragaki
2009/0223166 A1 * 9/2009 Ohata ..... E04B 1/2403 52/699
2010/0205891 A1 ‡ 8/2010 Bong
2011/0030305 A1 ‡ 2/2011 Karns
2014/0182234 A1 * 7/2014 Yang ..... E04B 1/24 52/655.1
2014/0325932 A1 * 11/2014 Tran ..... E04C 5/162 52/700
2015/0096244 A1 ‡ 4/2015 Richards
2015/0275501 A1 * 10/2015 Houghton ..... E04B 1/2403 52/854
2016/0356033 A1 * 12/2016 Houghton ..... E04B 1/2403
2018/0274223 A1 * 9/2018 Richards ..... E04B 1/2403

FOREIGN PATENT DOCUMENTS

KR 20040106829 A ‡ 12/2004
KR 20040106829 A 12/2004
KR 100516332 B1 ‡ 9/2005
KR 100516332 B1 9/2005
WO 2016036564 A1 3/2016
WO WO-2016036564 A1 ‡ 3/2016

OTHER PUBLICATIONS

International Search Report and Written Opinion from International Application No. PCT/US16/65623 dated Mar. 10, 2017.‡
Non-Final Office Action for U.S. Appl. No. 15/516,834 dated Aug. 30, 2018.‡
U.S. Appl. No. 15/516,834, filed Apr. 4, 2017.‡
U.S. Appl. No. 62/265,362, filed Dec. 9, 2015.‡
U.S. Appl. No. 62/549,853, filed Aug. 24, 2017.‡
International Search Report and Written Opinion from International Application No. PCT/US16/65623 dated Mar. 10, 2017.
International Search Report and Written Opinion from International Application No. PCT/US2015/047006 dated Nov. 23, 2015.
Non-Final Office Action for U.S. Appl. No. 15/500,991 dated Jan. 18, 2018.
Notice of Allowance for U.S. Appl. No. 15/500,991 dated Jun. 18, 2018.
Notice of Allowance for U.S. Appl. No. 15/500,991 dated Oct. 2, 2018.
U.S. Appl. No. 15/500,991, filed Feb. 1, 2017.
U.S. Appl. No. 62/044,738, filed Sep. 2, 2014.
Notice of Allowance for U.S. Appl. No. 15/516,834 dated Dec. 23, 2019.

* cited by examiner
‡ imported from a related application

MOMENT-RESISTING FRAMES AND KITS FOR ASSEMBLING THE SAME

CROSS-REFERENCE TO RELATED APPLICATIONS

This application is a continuation application of U.S. patent application Ser. No. 15/500,991 filed on 1 Feb. 2017, which is a U.S. National Stage Application of PCT International Application PCT/US/2015/047006 filed on 26 Aug. 2015, which claims priority to U.S. Provisional Application No. 62/044,738 filed on 2 Sep. 2014, the disclosure of each of which is incorporated herein, in its entirety, by this reference.

BACKGROUND

Structural systems (e.g., buildings and similar structures) commonly include interconnected structural members, such as beams and columns. For example, beams and columns may form general support structures and/or frames of a building and may secure one or more building components, such as walls, floors, roof, etc. The structural members of the building may experience loads that may lead to failure thereof during a seismic event, wind loading event, etc. Furthermore, in some systems, the beams and columns may include structural fuses that absorb energy imparted onto the structure by the seismic event and dissipate such energy (e.g., through failure thereof). Failure of such structural fuses, however, may require repair and/or replacement thereof.

Buildings may be designed to resist lateral forces (e.g., from seismic events) by including beams and columns connected together. For example, a column may be provided that extends in a substantially vertical direction. The column may be an I-beam that includes two column flanges and a column web extending therebetween. A beam may be positioned adjacent to a portion of a flange of the column and may extend in a direction from the column, such as in a direction that is generally perpendicular to the flange. Portions of the beam may be welded to the column flange to form a moment-resisting connection between the column and the beam. Additionally, such column-to-beam connections may include continuity plates welded to the column and doubler plates welded to the column web.

Accordingly, users and manufacturers of structural members and systems for buildings continue to seek improvements of moment-resisting connections.

SUMMARY

Various embodiments disclosed herein relate to moment-resisting frames, kits for assembling such moment-resisting frames, and methods of repairing such moment-resisting frames. In some embodiments, the moment-resisting frames may include a beam connected to a column using a moment-resisting connection. The moment-resisting connection may include at least one exterior doubler plate ("EDP") connected to the column and two or more connectors that are connected to both the beam and the EDP. In some embodiments, the moment-resisting frames may require relatively less welding than conventional beam-to-column connections. Additionally or alternatively, such moment-resisting frames may eliminate the need for components typically used in conventional beam-to-column connections (e.g., continuity plates).

In an embodiment, a moment-resisting frame is disclosed. The moment-resisting frame includes a column. The column includes a first column flange, a second column flange spaced from the first column flange, and a column web connected to and extending between the first column flange and the second column flange. Each of the first column flange and the second column flange includes two outer side surfaces spaced from the column web. The moment-resisting frame also includes at least one EDP. The at least one EDP includes an interior doubler surface and an exterior doubler surface spaced from the interior doubler surface. The interior doubler surface is positioned adjacent to one of the two outer side surfaces of the first column flange and one of the two outer side surfaces of the second column flange. The at least one EDP is connected to the column. The moment-resisting frame further includes a beam. The beam includes at least one connection surface extending along a longitudinal axis of the beam. The moment-resisting frame additionally includes two or more connectors. Each of the two or more connectors includes a first portion and a second portion extending from the first portion to an end thereof. The first portion is positioned adjacent to the at least one exterior doubler plate and connected to the at least one exterior doubler plate. The second portion is connected to the at least one connection surface of the beam.

In an embodiment, a kit for assembling a moment-resisting frame, which includes a column and a beam, is disclosed. The column includes a first column flange, a second column flange spaced from the first column flange, and a column web connected to and extending between the first column flange and the second column flange. Each of the first column flange and the second column flange includes an exterior column flange surface, an interior column flange surface spaced from the exterior column flange surface, and two outer side surfaces spaced from the column web. The beam includes at least one connection surface extending along a longitudinal axis of the beam. The kit includes at least one EDP. The at least one EDP includes an interior doubler surface. The interior doubler surface exhibits a width that is greater than a distance between the interior column flange surface of the first column flange and the interior column flange surface of the second column flange of the column to which the at least one EDP is configured to be connected. The at least one EDP also includes an exterior doubler surface spaced from the interior doubler surface. The kit also includes two or more connectors. Each of the two or more connectors including a first portion configured to be connected to the at least one exterior doubler plate and a second portion extending from the first portion to an end thereof. The second portion defines a plurality of connector holes therein that correspond to a plurality of beam holes defined by the beam to which the two or more connectors are configured to be connected.

In an embodiment, a method of repairing a yielded component of a moment-resisting frame is disclosed. The moment-resisting frame includes a column. The column includes a first column flange, a second column flange spaced from the first column flange, and a column web connected to and extending between the first column flange and the second column flange. Each of the first column flange and the second column flange includes two outer side surfaces spaced from the column web. The moment-resisting frame also includes at least one EDP. The at least one EDP includes an interior doubler surface and an exterior doubler surface spaced from the interior doubler surface. The interior doubler surface is positioned adjacent to one of the two outer side surfaces of the first column flange and one of the two outer side surfaces of the second column flange. The at least one exterior doubler plate is connected to the column. The moment-resisting frame further includes a beam. The beam includes at least one connection surface extending along longitudinal axis of the beam. The moment-resisting frame finally includes two or more connectors. The two or more connectors include a first portion and a second portion extending from the first portion to an end thereof. The first portion is positioned adjacent to the at least one EDP and connected to the at least one EDP. The second portion is connected to the at least one connection surface. The moment-resisting frame includes a structural fuse formed on a component. The component includes at least one of the at least one exterior doubler plate or the two or more connectors. The method includes repairing the yielded component of the moment-resisting frame. For example, repairing the yielded component of the moment-resisting frame may include replacing the component by detaching the component from the moment-resisting frame and attaching another component to the moment-resisting frame that is configured substantially the same as the component before the component yielded.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Various embodiments disclosed herein relate to moment-resisting frames, kits for assembling such moment-resisting frames, and methods of repairing such moment-resisting frames. In some embodiments, the moment-resisting frames may include a beam connected to a column using a moment-resisting connection. The moment-resisting connection may include at least one EDP that is connected to the column and two or more connectors that are connected to both the beam and the EDP. In some embodiments, the moment-resisting frame may require relatively less welding than conventional beam-to-column connections. Additionally or alternatively, such moment-resisting frames may eliminate the need for components typically used in conventional beam-to-column connections (e.g., continuity plates).

Figure 1A:
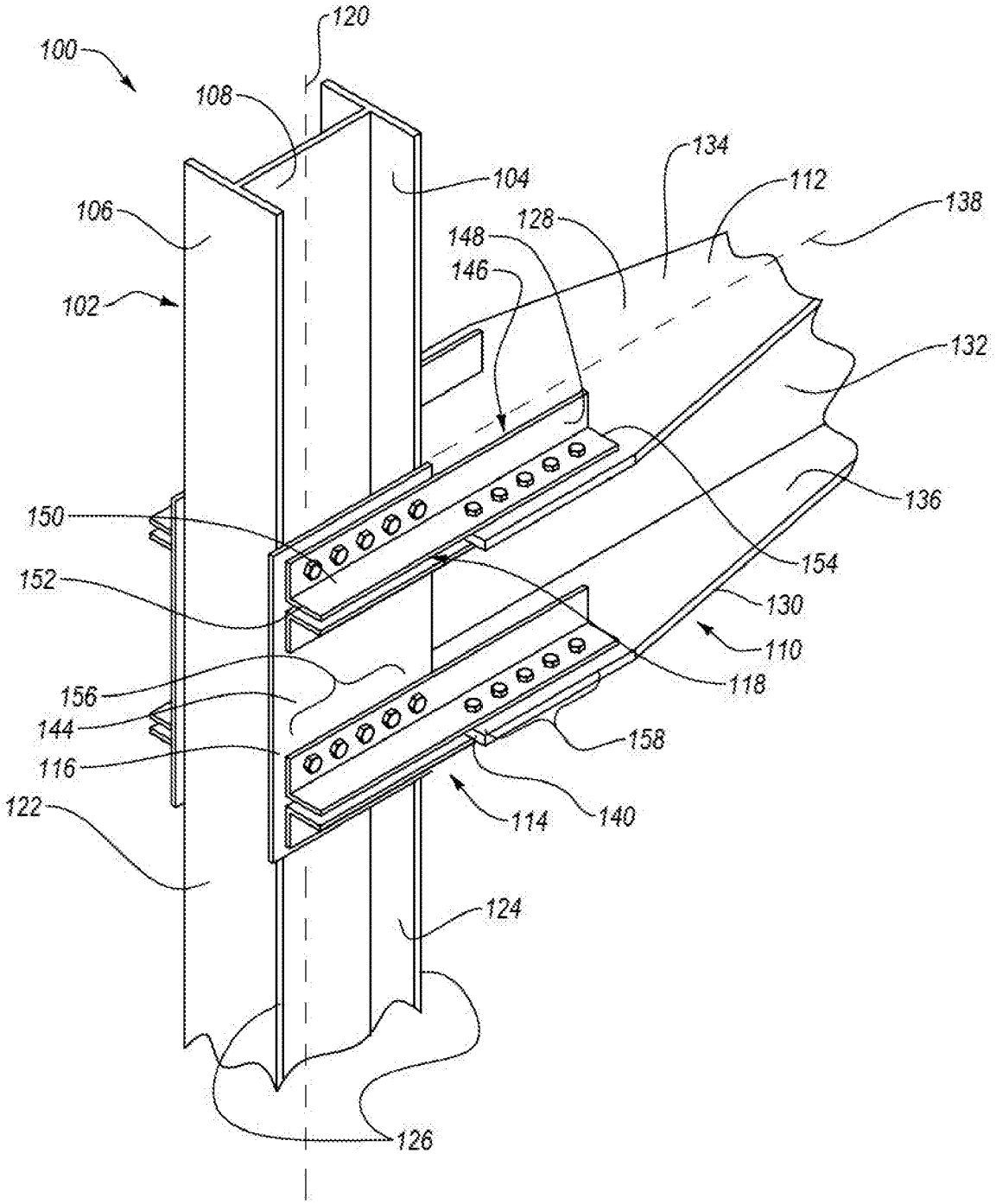
FIGS. 1A-1C are isometric, side elevational, and top plan views, respectively, of a portion of a moment-resisting frame, according to an embodiment.
Figure 1B:
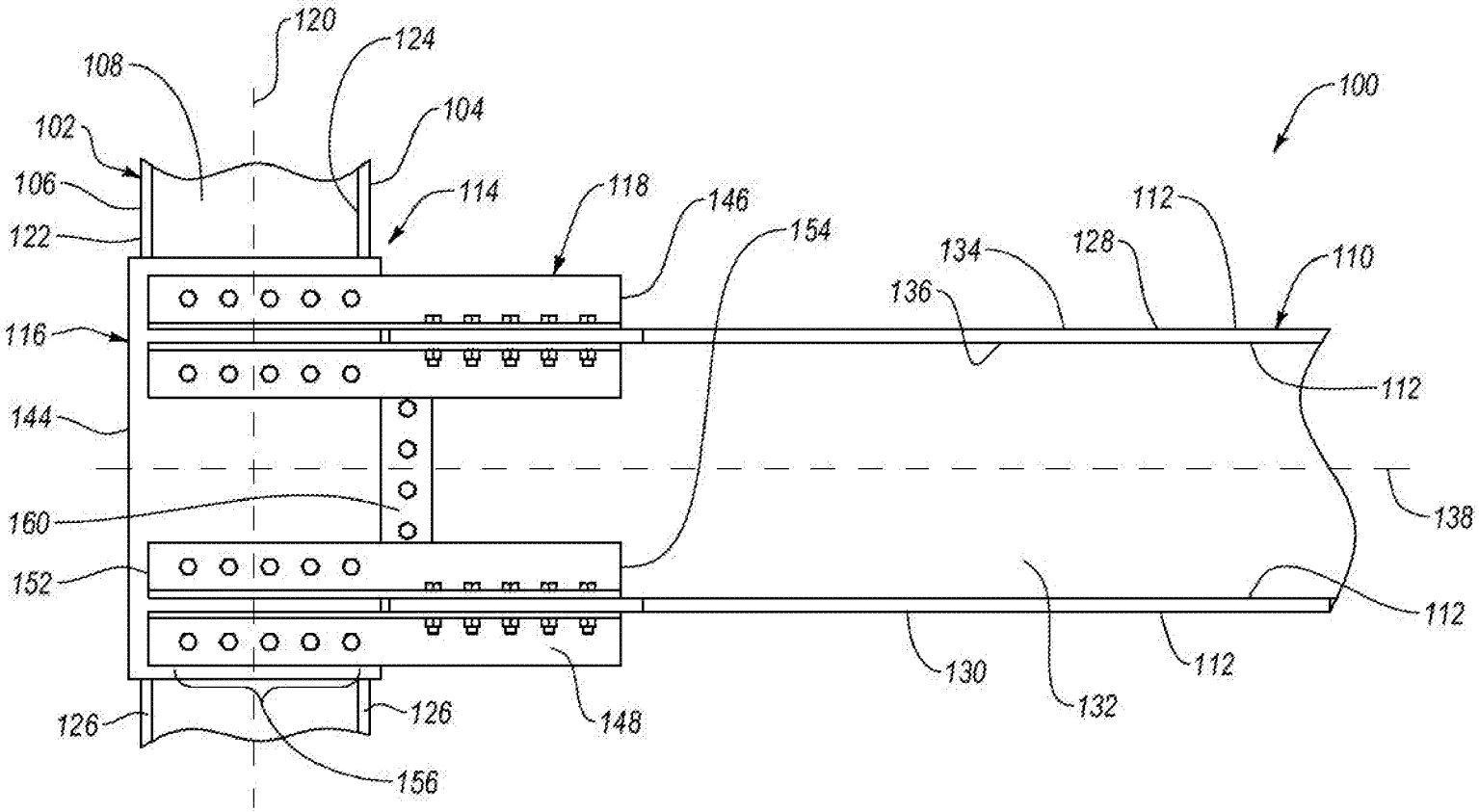
Figure 1C:
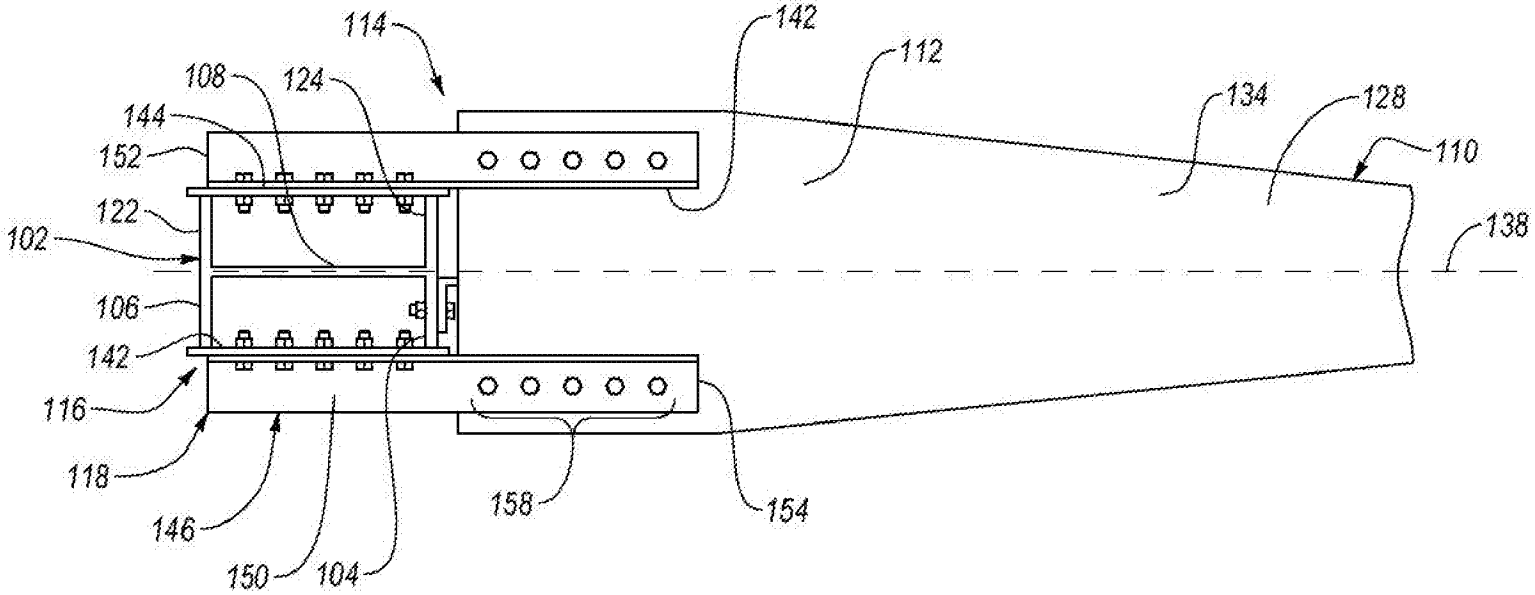

FIGS. 1A-1C are isometric, side elevational, and top plan views, respectively, of a portion of a moment-resisting frame 100, according to an embodiment. The moment-resisting frame 100 includes a column 102 that may generally exhibit an I-beam configuration. For example, the column 102 may include a first column flange 104, a second column flange 106 spaced from the first column flange 104, and a column web 108 connected to and extending between the first column flange 104 and the second column flange 106. The moment-resisting frame 100 further includes a beam 110 that includes at least one connection surface 112 (e.g., flange). The beam 110 is connected to the column 102 using a moment-resisting connection 114. The moment-resisting connection 114 includes at least one EDP 116 that is positioned adjacent to the first column flange 104 and the second column flange 106 and spaced from the column web 108. The EDP 116 is further connected to the column 102. The moment-resisting connection 114 further includes two or more connectors 118 configured to connect the beam 110 to the EDP 116. As such, the beam 110 is connected to the column 102 via the EDP 116 and the connectors 118, thereby forming a moment-resisting connection between the column 102 and the beam 110 without using a continuity plate and/or without beam-to-column weld.

The column 102 may have a generally I-shaped cross-section. For example, the column 102 may include the first column flange 104, the second column flange 106, and the column web 108. The first column flange 104 and the second column flange 106 may be connected to (e.g., attached to or integrated with) the column web 108. Each of the first column flange 104 and the second column flange 106 includes an exterior column flange surface 122, an interior column flange surface 124 that is spaced from the exterior column flange surface 122 and connected to the column web 108, and two outer side surfaces 126 that extend therebetween. The two outer side surfaces 126 may be spaced from the column web 108. In some embodiments, the two outer side surfaces 126 are distinct from the exterior column flange surface 122 and the interior column flange surface 124. In other embodiments, the two outer side surfaces 126 may be integrated with the exterior column flange surface 122 and/or the interior column flange surface 124 (e.g., the exterior column flange surface 122 and the interior column flange surface 124 may meet substantially at a point). The first column flange 104, the second column flange 106, and the column web 108 may extend along a column longitudinal axis 120. The column longitudinal axis 120 is typically a generally vertical axis, but the column longitudinal axis 120 may be a generally horizontal axis or any other suitable axis.

In an embodiment, the first column flange 104 and/or the second column flange 106 exhibit a width (e.g., measured between the two outer side surfaces 126) that is substantially constant along the column longitudinal axis 120. In an embodiment, the first column flange 104 and/or the second column flange 106 may exhibit a width that varies along the column longitudinal axis 120. For example, the width of the first column flange 104 and/or the second column flange 106 may exhibit a first width at a first location on the column 102 that is greater than or less than a second width at a second location on the column 102. Examples of columns having flanges exhibiting widths that vary are disclosed in U.S. Patent Application Publication No. 20150096244 (now issued as U.S. Pat. No. 9,200,442), the disclosure of which is incorporated herein, in its entirety, by this reference.

As discussed above, the beam 110 includes the at least one connection surface 112 that is configured to be connected to the column 102. For example, the connection surface 112 may include a substantially flat surface, a curved surface, etc. For example, in the illustrated embodiment, the beam 110 exhibits a generally I-shaped cross-section. Such a beam 110 may exhibit a first beam flange 128, a second beam flange 130 spaced from the first beam flange 128, and a beam web 132 connected to (e.g., attached to or integrated with) and extending between the first beam flange 128 and the second beam flange 130. Each of the first beam flange 128 and the second beam flange 130 may include an exterior beam flange surface 134 and an interior beam flange surface 136 spaced from the exterior beam flange surface 134 and connected to the beam web 132. In such an example, the exterior beam flange surface 134 and/or the interior beam flange surface 136 of the first beam flange 128 and/or second beam flange 130 may be configured to be the connection surface 112.

The first beam flange 128, the second beam flange 130, and the beam web 132 may extend along a beam longitudinal axis 138. Similarly, the connection surface 112 may extend along the beam longitudinal axis 138. In some embodiments, the beam longitudinal axis 138 may extend at least substantially perpendicularly relative to the column longitudinal axis 120 (e.g., substantially horizontal if the column longitudinal axis 120 is substantially vertical). However, in other embodiments, the beam longitudinal axis 138 may extend at a non-perpendicular, oblique angle relative to the column longitudinal axis 120.

The first beam flange 128 and/or the second beam flange 130 exhibits a width (e.g., measured in a direction that is substantially perpendicular to the beam longitudinal axis 138 of the beam 110) that varies with location along the length of the beam longitudinal axis 138. In an embodiment, the first beam flange 128 and the second beam flange 130 may extend between a first beam end 140 and a second beam end (not shown). The first beam flange 128 and/or the second beam flange 130 may exhibit a first width at a first location from the first beam end 140. The first beam flange 128 and/or the second beam flange 130 may exhibit a second width at a second location from the first beam end 140 that is less than the second width, where the second location is farther from the first beam end 140 than the first location. In other words, the width of the first beam flange 128 and/or the second beam flange 130 may generally taper and/or gradually decrease between the first location and the second location. In an embodiment, the first beam flange 128 and/or the second beam flange 130 may exhibit a third width that is greater than the second width at a third location from the first beam end 140 that is greater than the second width, where the third location is farther from the first beam end 140 than the second location (e.g., the first beam flange 128 and/or second beam flange 130 may exhibit a generally "bow-tie" geometry). In an embodiment, the variation in the widths of the first beam flange 128 and/or second beam flange 130 may be configured to produce approximately even or uniform load distribution during a seismic even, wind loading event, or other similar event. Examples of beams having flanges exhibiting widths that vary with location are disclosed in U.S. Patent Application Publication No. 2015/0096244, the disclosure of which was previously incorporated herein. However, while portions of the first beam flange 128 and/or second beam flange 130 may vary, other portions of the first beam flange 128 and/or second beam flange 130 may exhibit a relatively constant width. For example, the illustrated first beam flange 128 (FIG. 1B) exhibits a substantially constant width at and near the first beam end 140. Furthermore, in other embodiments, the width of the beam 110 may be substantially constant.

The moment-resisting connection 114 is configured to connect the beam 110 to the column 102, while reducing the amount of welding, and, in particular, on-site welding (e.g., welding that must be performed at the construction site and cannot be performed at some other location) required to form the moment-resisting connection 114. In some embodiments, the need for on-site welding may even be eliminated. Reducing the amount of welding needed to connect the beam 110 to the column 102 may decrease the time and expense required to connect the beam 110 to the column 102. Additionally, the moment-resisting connection 114 may be configured to eliminate the need for some components typically used in beam-to-column connections, thereby further decreasing the time and expense required to connect the beam 110 to the column 102. For example, the beam 110 may be connected to the column 102 without the use of continuity plates or doubler plates secured directly to the column web 108.

As discussed above, the moment-resisting connection 114 includes the at least one EDP 116 (e.g., two EDPs 116) that is connected to the column 102. The EDP 116 includes an interior doubler surface 142 and an exterior doubler surface 144 that is spaced from the interior doubler surface 142.

The interior doubler surface 142 is configured to be positioned adjacent to (e.g., directly contacting) one of the two outer side surfaces 126 of the first column flange 104 and one of the two outer side surfaces 126 of the second column flange 106. As such, in an embodiment, the interior doubler surface 142 may exhibit a width that is greater than the distance between the interior column flange surfaces 124 of first column flange 104 and the second column flange 106 (e.g., measured at the outer side surfaces 126 thereof). For example, the interior doubler surface 142 may exhibit a width that is substantially the same as or greater than the distance between the exterior column flange surfaces 122 of the first column flange 104 and the second column flange 106. The width of the interior doubler surface 142 is measured a direction that is substantially perpendicular to the column longitudinal axis 120 when the EDP 116 is connected to the column 102. In one embodiment, the moment-resisting connection 114 may include two EDPs 116 connected to the column 102. The interior doubler surface 142 of each of the two EDPs 116 may be positioned adjacent to different outer side surfaces 126 of the first column flange 104 and the second column flange 106.

The exterior doubler surface 144 is configured to facilitate attachment of the beam 110 to the EDP 116. To facilitate attachment of the beam 110 to the EDP 116, the exterior doubler surface 144 may exhibit a height (e.g., measured in a direction that is substantially parallel to the column longitudinal axis 120 and/or substantially perpendicular to the beam longitudinal axis 138) that is greater than the distance from the interior beam flange surfaces 136 of the first beam flange 128 and the second beam flange 130 (e.g., measured at the first beam end 140). For example, the exterior doubler surface 144 may exhibit a height that is greater than the distance between an uppermost region one connector 118 connected to the first beam flange 128 and a lowermost region of another connector 118 connected to the second beam flange 130.

In an embodiment, the EDP 116 may be welded to the column 102. For example, the interior doubler surface 142 may be welded one of the two outer side surfaces 126 of the first column flange 104 and the second column flange 106. The EDP 116 may be welded to the column 102 off-site (e.g., any location that is not on-site). Alternatively, the EDP 116 may be connected to the column 102 using other attachment methods, such as fasteners (e.g., bolts) or other suitable technique.

The two or more connectors 118 may include any suitable device that is configured to connect the beam 110 to the EDP 116. For example, the connectors 118 may include one or more angles 146 (e.g., splice angle, solid angle, slotted angle, etc.). The angle 146 may exhibit a generally L-shaped cross-section. For example, the angle 146 may include a first connector wall 148 (FIG. 1B) and a second connector wall 150 (FIG. 1C) connected to (e.g., attached to and/or integrated with) and extending from the first connector wall 148. The first connector wall 148 may extend longitudinally parallel to the beam longitudinal axis 138 and may extend crosswise substantially parallel to the column longitudinal axis 120. The second connector wall 150 may extend substantially perpendicularly from the first connector wall 148 such that the second connector wall 150 extends longitudinally parallel to the beam longitudinal axis 138 and extends crosswise perpendicularly to the column longitudinal axis 120.

Each connector 118 may extend between a first connector end 152 and a second connector end 154. In an embodiment, each connector 118 may include a first portion 156 that is configured to connect to the EDP 116 and a second portion 158 that is configured to connect to the beam 110. For example, the first portion 156 may extend from the first connector end 152 to an intermediate location of the connector 118 between the first and second connector end 152, 154. The first connector wall 148 of the first portion 156 may be positioned adjacent to the exterior doubler surface 144 and connected to the EDP 116. For example, the first connector wall 148 of the first portion 156 may be connected to the EDP 116 using bolts, rivets, threaded connectors, etc. In such an example, the first connector wall 148 of the first portion 156 may define a plurality of holes therein (e.g., sixth holes 874F shown in FIG. 8). Each of the plurality of holes defined by the first connector wall 148 may correspond to an equal number of holes defined by the EDP 116 (e.g., fifth holes 874E shown in FIG. 8). However, the first connector wall 148 of the first portion 156 may be connected to the EDP 116 using other methods, such as welding. The first connector wall 148 of the first portion 156 may be connected to the EDP 116 off-site. Additionally, the second portion 158 of each connector 118 may extend from the first portion 156 to the second connector end 154. The second connector wall 150 of the second portion 158 may be connected to the beam 110 using bolts, rivets, threaded connections, welds, etc. For example, the second connector wall 150 of the second portion 158 may define a plurality of holes (e.g., seventh holes 874G shown in FIG. 8) that may correspond to an equal number of holes (e.g., eight holes 874H shown in FIG. 8) defined by the connector surface 112.

In an embodiment, the connectors 118 may be substantially straight in a longitudinal direction thereof. In an embodiment, the connectors 118 may be bent at one or more locations such that the connectors 118 are not substantially straight in a longitudinal direction thereof. For example, the connector 118 may be slightly bent at a location at or near the junction between the first portion 156 and the second portion 158. The slight bent in the connector 118 may be in a direction away from the column 102 and/or away the connection surface 112. The slight bend in the connector 118 may be configured to facilitate placement of the beam 110. Each connector 118 that is slightly bent may be configured to straighten when the connector 118 is connected to the beam 110.

In an embodiment, one or more of the first beam flange 128, second beam flange 130, or the connection surface 112 may exhibit a width at and/or near the first beam end 140 that is greater than the combined thickness of the column 102 and any of the EDPs 116 connected to the column 102. The thickness of the column 102 is measured between the two outer side surfaces 126 of the first column flange 104 or the second column flange 106. The thickness of any of the EDPs 116 connected to the column 102 is measured between the interior doubler surface 142 and exterior doubler surface 144. Additionally, in some embodiments, the first beam flange 128 and/or second beam flange 130 may exhibit a width at and/or near the first beam end 140 that is also greater than the combined thickness of the column 102 and any of the EDPs 116 connected to the column 102 and the combined width any of the connectors 118 connected to the EDP 116. The width of each connector 118 is measured from one edge of the second connector wall 150 (e.g., the edge of the second connector wall 150 that contacts or is positioned immediately adjacent to the EDP 116 when the connector 118 is connected to the EDP 116) to an opposing edge of the second connector wall 150. This width of the first beam flange 128 and/or second beam flange 130 may facilitate attachment of the beam 110 to the column 102 using angles 146 (or other connectors 118) without having to significantly bend the angles 146 towards the column 102. As such, in an embodiment, any of the EDPs 116 connected to the column 102 may not extend around or partially enclose a portion of the beam 110. In an embodiment, the first beam flange 128 and/or the second beam flange 130 may exhibit a width that varies, thereby allowing to the first beam flange 128 and/or second beam flange 130 to exhibit an average width that is less than the width thereof at or near the first beam end 140 thereby reducing the total weight and/or cost of the beam 110.

The illustrated moment-resisting connection 114 includes eight connectors 118 and two EDPs 116. As such, each of the two EDPs 116, the first beam flange 128, and the second beam flange 130 may include four connectors 118 connected thereto. For example, the two EDPs 116 may be connected to opposing outer side surfaces 126 of the first column flange 104 and the second column flange 106 (FIG. 1C). Each of the two EDPs 116 may have, for example, four connectors 118 connected thereto (FIG. 1B). The second portion 158 of each of the four connectors 118 connected to each EDP 116 may be positioned adjacent to the exterior beam flange surface 134 of the first beam flange 128, the interior beam flange surface 136 of the first beam flange 128, the exterior beam flange surface 134 of the second beam flange 130, and the interior beam flange surface 136 of the second beam flange 130, respectively. Each second portion 158 may be connected to the beam 110. However, in other embodiments, less than eight connectors 118 may be used such as one, two, or three per EDP 116.

In the illustrated embodiment, the moment-resisting connection 114 does not include continuity plates and/or doubler plates directly connected to the column web 108. For example, the EDP 116 and the two or more connectors 118 may perform the functions of and/or eliminate the need for continuity plate and doubler plates directly connected to the column web 108. However, in other embodiments, the moment-resisting connection 114 may include continuity plates and/or doubler plates connected to the column web 108 to further strengthen the moment-resisting connection 114.

In some embodiments, the beam 110 may be connected to the column 102 using the moment-resisting connection 114 and a non-moment-resisting connection 160. The non-moment-resisting connection 160 may include a fin plate, an end plate (e.g., a flexible end plate), or another simple beam-to-column connection. For example, a fin plate may be welded or otherwise connected to a first column flange 104 or a second column flange 106 of the column 102 and configured to connect (e.g., using bolts, rivets, threaded connections, etc.) to the beam web 132 of the beam 110. The non-moment-resisting connection 160 may resist shear forces, but may have negligible resistance to moment-inducing forces. In some embodiments, the non-moment-resisting connection 160 may be omitted.

Figure 2:
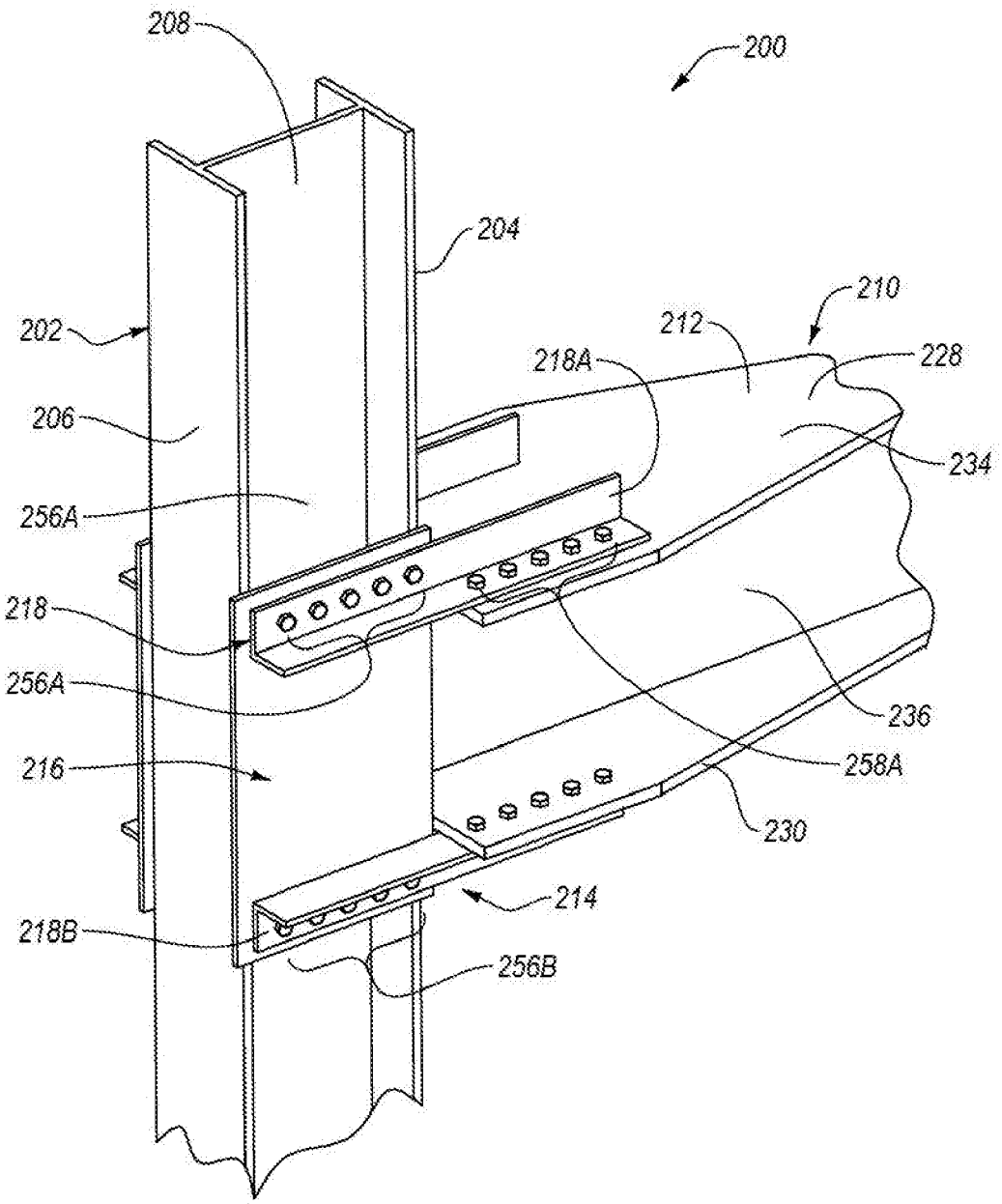
FIG. 2 is an isometric view of a portion of a moment-resisting frame, according to an embodiment.

FIG. 2 is an isometric view of a portion of a moment-resisting frame 200, according to an embodiment. The illustrated moment-resisting frame 200 may be substantially similar to the moment-resisting frame 100 described in relation to FIGS. 1A to 1C. For example, the moment-resisting frame 200 may include a column 202. The column 202 may include a first column flange 204, a second column flange 206, and a column web 208. The moment-resisting connection 214 further includes a beam 210 including at least one connection surface 212 (e.g., one or more surfaces of a first beam flange 228 and/or second beam flange 230). The beam 210 may be connected to the column 202 using a moment-resisting connection 214. The moment-resisting connection 214 includes at least one EDP 216 that is spaced from the column web 208 and is connected to the column 202. The moment-resisting connection 214 further includes two or more connectors 218 that are connected to the EDP 216 and that the at least one connection surface 212.

However, the illustrated moment-resisting connection 214 only includes two connectors 218 that are connected to each EDP 216. For example, the moment-resisting connection 214 may include a total of four connectors 218 if the moment-resisting connection 214 includes two EDPs 216. In an embodiment, each EDP 216 that is connected to the column 202 may include a first connector 218A and a second connector 218B connected thereto. The first connector 218A may include a first portion 256A that is connected to the EDP 216 and a second portion 258A that is connected to the first beam flange 228. In particular, the second portion 258A may be positioned adjacent to an exterior beam flange surface 234 of a first beam flange 228. Similarly, the second connector 218B may include a first portion 256B that is connected to the EDP 216 and a second portion (not shown, obscured by beam) that is connected to the second beam flange 230. In particular, the second portions 258B may be positioned adjacent to an exterior beam flange surface (not shown, obscured by beam) of the second beam flange 230. In other embodiments, the second portion 258A, 258B of at least one of the first connector 218A or the second connector 218B, respectively, may be positioned adjacent to an interior beam flange surface 236 of the first beam flange 228 or second beam flange 230, respectively.

In other embodiments, each EDP 216 that is connected to the column 202 may include any number of connectors 218 connected thereto. For example, each EDP 216 may only include a single connector 218 connected thereto. The single connector 218 may also be connected to a connection surface 212. In an embodiment, each EDP 216 may include three connectors 218 connected thereto. Each of the three connectors 218 may be connected to, for example, three different connection surfaces 212. The exact number of connectors 218 connected to each EDP 216 may depend on geographical location of the moment-resisting frame. For example, a moment-resisting frame 200 located at a geographical location that may have weak to no seismic activity may only include a single connector 218 connected to each EDP 216. However, a moment-resisting frame 200 present at a geographical location that has significant seismic activity may include four connectors 218 connected to each EDP 216. Additionally, the number of connectors 218 connected to each EDP 216 depends on the structural needs of the building at that specific connection.

Figure 3:
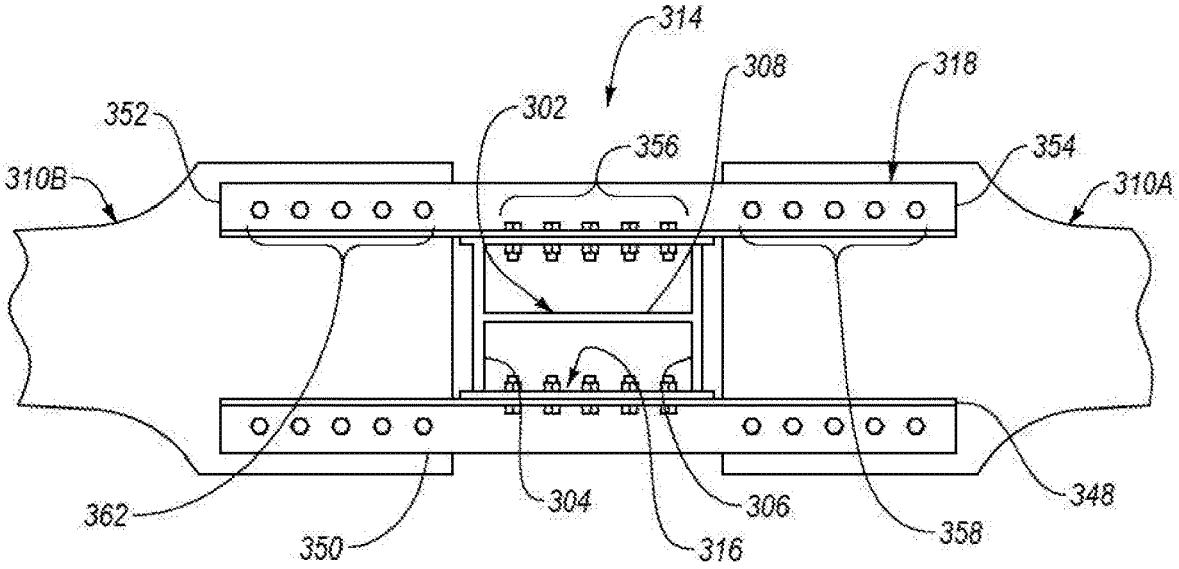
FIG. 3 is a top plan view of a moment-resisting frame including a first beam and a second beam connected to a column, according to an embodiment.

FIG. 3 is a top plan view of a moment-resisting frame 300 including a first beam 310A and a second beam 310B connected to a column 302, according to an embodiment. The moment-resisting frame 300 may be substantially similar to the moment-resisting frames 100 and 200 described in relation to FIGS. 1A-2. For example, the moment-resisting frame 300 may include a column 302. The column 302 may include a first column flange 304, a second column flange 306, and a column web 308. The moment-resisting frame 300 further includes a moment-resisting connection 314. The moment-resisting connection 314 includes at least one EDP 316 that is spaced from the column web 308 and is connected to the column 302. The moment-resisting connection 314 further includes two or more connectors 318 that are connected to the EDP 316.

The two or more connectors 318 may be configured to connect both a first beam 310A and a second beam 310B to the column 302. In an embodiment, each connector 318 may include a first connector end 352, a second connector end 354, a first connector wall 348, and a second connector wall 350. Each connector 318 may include a first portion 356 that is spaced from both the first connector end 352 and a second connector end 354. The first connector wall 348 of the first portion 356 may be configured to be connected to an EDP 316 connected to the column 302. For example, the first connector wall 348 of the first portion 356 may be welded, bolted, riveted, threadedly fastened, or otherwise attached to the EDP 316. Each connector 318 may include a second portion 358 that extends from the first portion 356 to the second connector end 354. The second connector wall 350 of the second portion 358 may be configured to be connected to the first beam 310A. The second connector wall 350 of the second portion 358 may be bolted, riveted, threadedly fastened, or otherwise attached to the first beam 310A. Additionally, each connector 318 may include a third portion 362 that extends from the first portion 356 to the first connector end 352. The second connector wall 350 of the third portion 362 may be configured to be connected to the second beam 310B. The second connector wall 350 of the second portion 358 may be bolted, riveted, threadedly fastened, or otherwise attached to the second beam 310B.

In an embodiment, each of the illustrated connectors 318 may be broken up into two different connectors. For example, each illustrated connector 318 may be broken up into a first connector and a second connector. The first connector may connect to the EDP 316 and to the first beam 310A. The second connector may connect to the EDP 316 and to the second beam 310B.

Figure 4A:
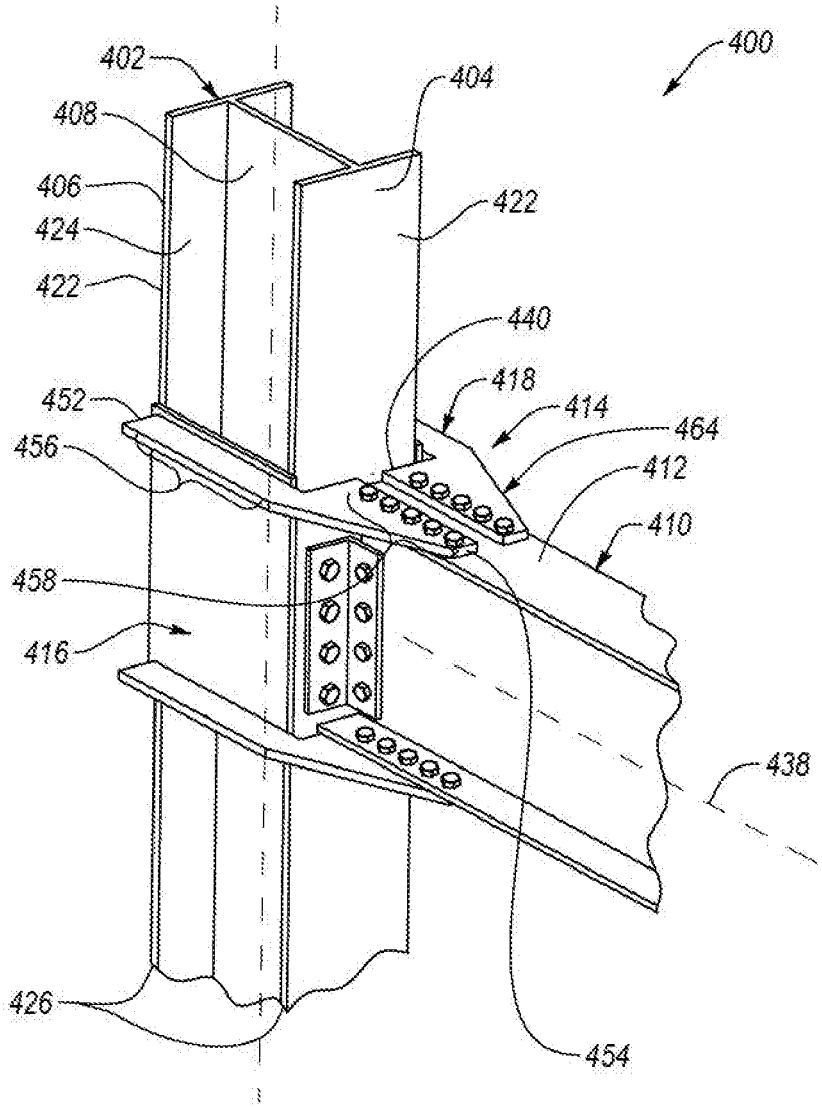
FIGS. 4A-4C are isometric, top plan, and side elevational views, respectively, of a portion of a moment-resisting frame, according to an embodiment.
Figure 4B:
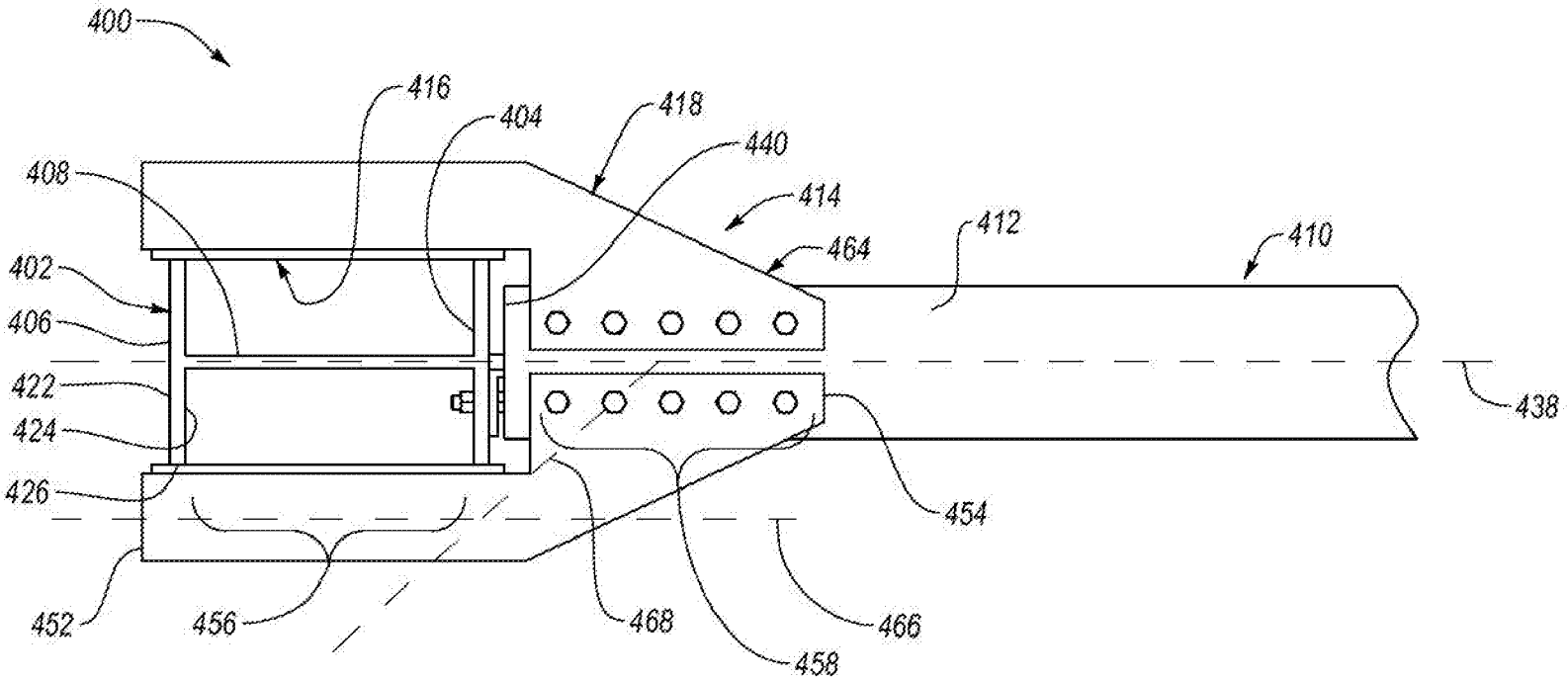
Figure 4C:
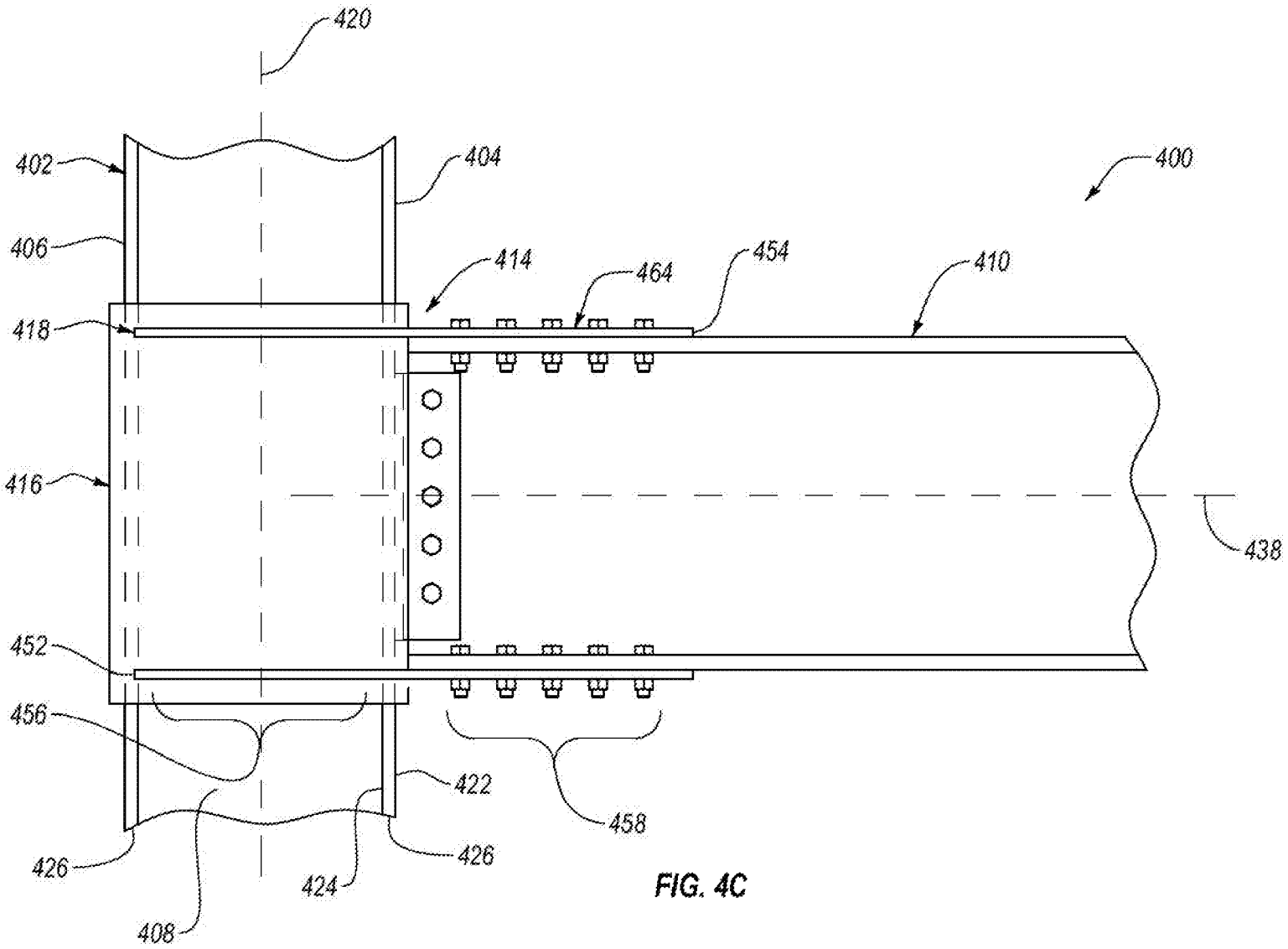

FIGS. 4A-4C are isometric view, top plan, and side elevational views, respectively, of a portion of a moment-resisting frame 400, according to an embodiment. The moment-resisting frame 400 includes a column 402 that is substantially similar to the column 102 described in relation to FIGS. IA-1C. For example, the column 402 includes a first column flange 404, a second column flange 406, and a column web 408. Each of the first column flange 404 and second column flange 406 may include an exterior column flange surface 422, an interior column flange 424, and two outer side surfaces 426. The moment-resisting frame 400 further includes a beam 410 that is connected to the column 402 using a moment-resisting connection 414. The moment-resisting connection 414 includes at least one EDP 416 that may be substantially similar to the EDP 116 described in relation to FIGS. 1A-1C. For example, the EDP 416 may be positioned adjacent to one of the outer side surfaces 426 of the first column flange 404 and the second column flange 406 and connected to the column 402. The moment-resisting frame 400 also includes two or more connectors 418 that are connected to the EDP 416 and at least one connection surface 412.

The illustrated beam 410 exhibits a width (e.g., measured in a direction that is perpendicular to the beam longitudinal axis 438) that is less than the combined thickness of the column 402 and any EDP 416 that is connected to the column 402. For example, the beam 410 may exhibit a width that is equal to or less than the thickness of the column 402. In an embodiment, the connection surface 412 may exhibit a width that is substantially the same as, slightly less than, or substantially less than the width of the column 402.

In an embodiment, the illustrated beam 410 exhibits a width that is substantially constant along the beam longitudinal axis 438. In other embodiment, the beam 410 may exhibit a width that varies (e.g., tapers) along the beam longitudinal axis 438. For example, the beam 410 may exhibit a first width at a first location and a second width that is less than the first width at a second location, where the second location is farther from a first beam end 440 than the first location. In particular, the width of the beam 410 may gradually decrease between the first location and the second location. However, in some embodiments, a third width of the beam 410 at a third location may be greater than the second width of the beam 410, where the third location is spaced farther from the first beam end 440 than the second location. The width of the beam 410 may be configured to vary in such a manner than the load applied to the beam 410 is substantially uniform along the beam longitudinal axis 438.

The illustrated connectors 418 including one or more splice plates 464 configured to connect to the EDP 416 and the beam 410. Each splice plate 464 may be substantially planar in a direction that is substantially parallel to the beam longitudinal axis 438 and in another direction that is substantially perpendicular to the beam longitudinal axis 438. Each splice plate 464 includes a first connector end 452 and a second connector end 454.

Each splice plate 464 includes a first portion 456 that extends from the first connector end 452 to a location spaced from the second connector end 454. The first portion 456 may be configured to be connected to the EDP 416. For example, the first portion 456 may be welded or otherwise connected to the EDP 416 using angles and fasteners. The first portion 456 includes a first portion axis 466 (e.g., a longitudinal axis of the first portion 456) that extends from the first connector end 452 towards a second portion 458 of the splice plate 464. The first portion axis 466 may be substantially parallel to the beam longitudinal axis 438. The first portion 456 may exhibit a width that is measured from a surface of the splice plate 464 that is connected to the column 402 to another surface that is generally opposite to the surface. In an embodiment, the first portion 456 may exhibit a width that is substantially constant along the first portion axis 466. In other embodiments, at least a portion of the first portion 456 may exhibit a width that varies. For example, the width of the first portion 456 may gradually increase from the first connector end 452 towards the second portion 458.

Each splice plate 464 includes a second portion 458 that is configured to connect to the beam 410. For example, the second portion 458 may define a plurality of holes therein that facilitate attachment of the second portion 458 to the at least one connection surface 412 using bolts, rivets, threaded fasteners, etc. The second portion 458 also includes a second portion axis 468 that extends from the center of the junction between the first portion 456 and the second portion 458 towards the center of the region of the second portion 458 that connects to the at least one connection surface 412 of the beam 410. The second portion axis 468 may extend at an oblique angle relative to the first portion axis 466. The second portion axis 468 may be selected such that at least a portion of the second portion 458 is positioned adjacent to the connection surface 412. The second portion 458 may exhibit a width that is measured in a direction that is perpendicular to the second portion axis 468. In one embodiment, the width of the second portion 458 may vary along the second portion axis 468.

In another embodiment, the connectors 418 may be substantially similar to the angle 146 described in relation to FIGS. 1A-1C. For example, the connectors 418 may exhibit a generally L-shaped cross-sectional geometry. However, the connector 418 may exhibit a bend at or near the junction between a first portion 456 and a second portion 458 that bends towards the beam 410. In such an embodiment, the connector 418 may be connected to the EDP 416 using welds, bolts, rivets, threaded fasteners, etc.

The embodiments and/or features described in relation to FIGS. 1A-3 may be incorporated into the moment-resisting frame 400. For example, the moment-resisting frame 400 may include four connectors 418 connected to each EDP 416 as shown in FIG. 1A. In an embodiment, the moment-resisting frame 400 may include a first beam and a second beam connected to the column 402.

In an embodiment, the moment-resisting frame 400 can include at least one plate (not shown), as described in U.S. Pat. No. 9,200,442, which was previously incorporated by reference herein. The plate may be attached to a flange of the beam 410 in any suitable manner (e.g., bolts or welding). The plate can be configured to at least one of increase a strength the beam 410 or facilitate attachment of the beam 410 to the connectors 418. In an embodiment, at least a portion of the plate may be wider than the flange to which the plate is attached. In other words, at least some portions of the plate may protrude outward past a perimeter of the flange to which the plate is attached. It is noted that the plate can be used in any of the embodiments disclosed herein.

Figure 5:
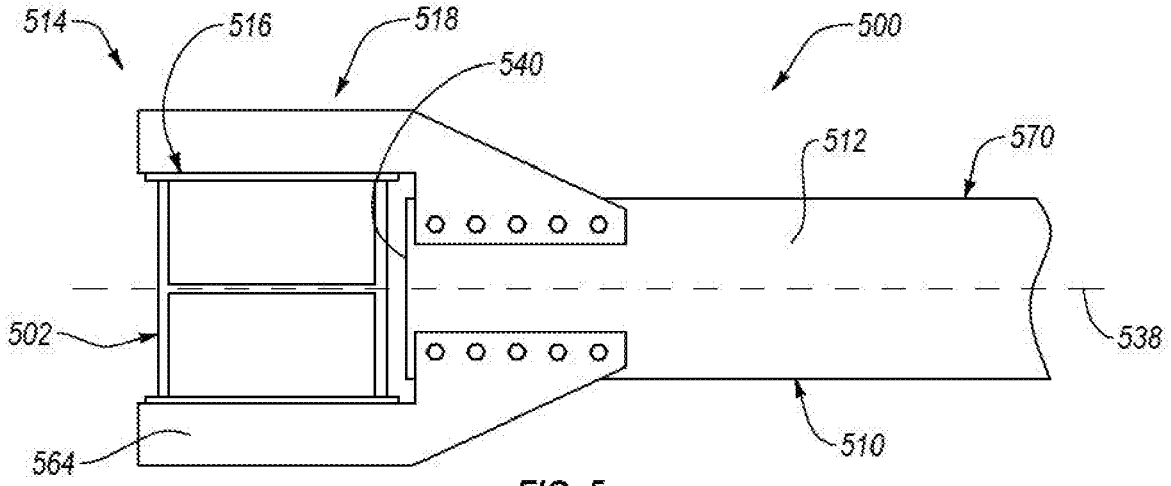
FIG. 5 is a top plan view of a moment-resisting frame including a hollow structural section, according to an embodiment.

FIG. 5 is a top plan view of a moment-resisting frame 500 including a hollow structural section 570 ("HSS"), according to an embodiment. The illustrated moment-resisting frame 500 may be substantially similar to the moment-resisting frame 400 discussed in relation to FIGS. 4A-4C. For example, the moment-resisting frame may include a beam 510 that is connected to a column 502 using a moment-resisting connection 514. The moment-resisting connection 514 may include at least one EDP 516 connected to the column 502 and two or more connectors 518 that connect to the EDP 516 and the beam 510.

The illustrated beam 510 includes a HSS 570. The HSS 570 may be used as the beam in any of the embodiments discloses herein. The HSS 570 may include any beam that exhibits a hollow cross-section and exhibits at least one connection surface 512. For example, the HSS 570 may exhibit a generally circular cross-section, a generally rectangular cross-section (e.g., a generally square cross-section), a generally ellipsoidal geometry, or any other suitable cross-sectional geometry. In an embodiment, the HSS 570 may exhibit a cross-sectional geometry that includes one or more corners that are rounded (e.g., a generally square cross-section including four rounded corners).

The illustrated HSS 570 includes at least one connection surface 512 that exhibits a width that is equal to or less than the combined thickness of the column 502 and any of the EDPs 516 that is connected to the column 502. As such, the two or more connectors 518 may include a splice plate 564 or similar connector (e.g., a bent angle) that is configured to connect to the HSS 570 and the EDP 516. However, in other embodiments, the connection surface 512 of the HSS 570 may exhibit a width that is greater the combined thickness of the column 502 and any of the EDPs 516 that is connected to the column 502. As such, the two or more connectors 518 may include an angle (not show) that connects to the HSS 570 and the EDP 516. However, the connectors 518 may include other connectors disclosed herein, such as the splice plate 564.

The at least one connection surface 512 may exhibit a width that is substantially constant along the beam longitudinal axis 538. In other embodiments, the at least one connection surface 512 may exhibit a width that varies along at least a portion of the beam longitudinal axis 538. For example, the at least one connection surface 512 may exhibit a first width at a first location and a second width that is less than the first width at a second location, where the second location is spaced further from a first beam end 540 than the first location. In other embodiments, the beam 510 may comprise a beam other than the HSS 570. For example, the beam 510 may be configured as a C-beam, a T-beam, or any other suitable beam.

Figure 6A:
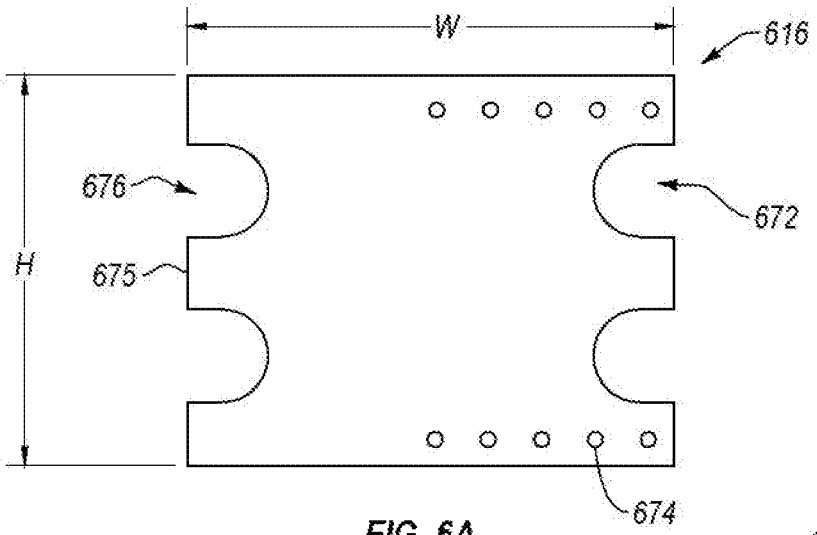
FIG. 6A is a front elevational view of an EDP that includes at least one structural fuse formed therein, according to an embodiment.

FIG. 6A is a front elevational view of an EDP 616 that includes at least one structural fuse 672 formed therein, according to an embodiment. The EDP 616 may be substantially similar to any of the EDPs disclosed herein and may be used in any of the embodiments disclosed herein. For example, the EDP 616 may exhibit a width "W" that is configured to be connected to a column (not shown). For example, the EDP 616 may exhibit a width "W" that is greater than a distance between interior column flange surfaces of a first column flange and a second column flange of the column to which the EDP 616 is configured to be connected. The EDP 616 may also have a height "H" that is configured to be connected to a beam (not shown) using two or more connectors (not shown). The EDP 616 may also define a plurality of holes 674 that are configured to facilitate connecting the EDP 616 to the connectors. For example, the plurality of holes 674 may be configured to connect at least one connector to the EDP 616 using bolts, rivets, threaded fasteners, etc. However, in some embodiments, the plurality of holes 674 may be omitted and the EDP 616 may be configured to be connected to the connectors using another attachment method, such as welding.

The EDP 616 includes at least one structural fuse 672 that is configured to dissipate seismic or other energy, while maintaining the beam connected to the column. For example, the at least one structural fuse 672 may be configured to preferentially yield (i.e., plastically deform) a portion of the EDP 616 that does not materially affect the connection between the column and the beam.

In an embodiment, the structural fuse 672 may include two or more cutouts 676 (e.g., four cutouts) that are formed in and partially defined by the EDP 616. The cutouts 676 are formed in a portion of the EDP 616 that is between two immediately adjacent portions of the EDP 616 configured to connect the connectors (e.g., two immediately adjacent sets of holes 674). Additionally, the cutouts 676 are spaced from each portion of the EDP 616 configured to connect to the connectors. As such, the EDP 616 does not define a plurality of holes at, near, and/or between the cutouts 676. The cutouts 676 are configured to cause the EDP 616 to preferentially yield (e.g., fail) in a portion of the EDP 616 that is at and/or between immediately adjacent cutouts 676. As such, if the EDP 616 yields, the portions of the EDP 616 that yield are remote from the portions of the EDP 616 configured to connect to the connectors and therefore may not materially affect the connection between the EDP 616 and the connectors. Additionally, portions of the EDP 616 that are remote from and/or not between the cutouts 676 may remain connected to the column if the EDP 616 preferentially yields.

The illustrated cutouts 676 are formed in an outer edge 675 of the EDP 616 and extend inwardly therefrom. However, the cutouts 676 may be formed in an interior region of the EDP 616 such that the EDP 616 completely defines an entire lateral periphery of the cutouts 676. Cutouts 676 formed in an interior region of the EDP 616 may be spaced from portions of the EDP 616 that are connected to the column and, therefore, may be less likely to materially affect the connection between the EDP 616 and the column.

The illustrated EDP 616 includes four cutouts 676 formed therein. However, the EDP 616 may include fewer cutouts 676 formed therein, such as one cutout, two cutouts, or three cutouts (e.g., two cutouts 676 formed in the outer edge 675 thereof and a cutout 676 formed in an interior region thereof). Alternatively, the EDP 616 may include more than four cutouts 676, such as five cutouts (e.g., the four illustrated cutouts 676 and an additional cutout formed in a portion of the EDP 616 between the four illustrated cutouts 676).

Figure 6B:
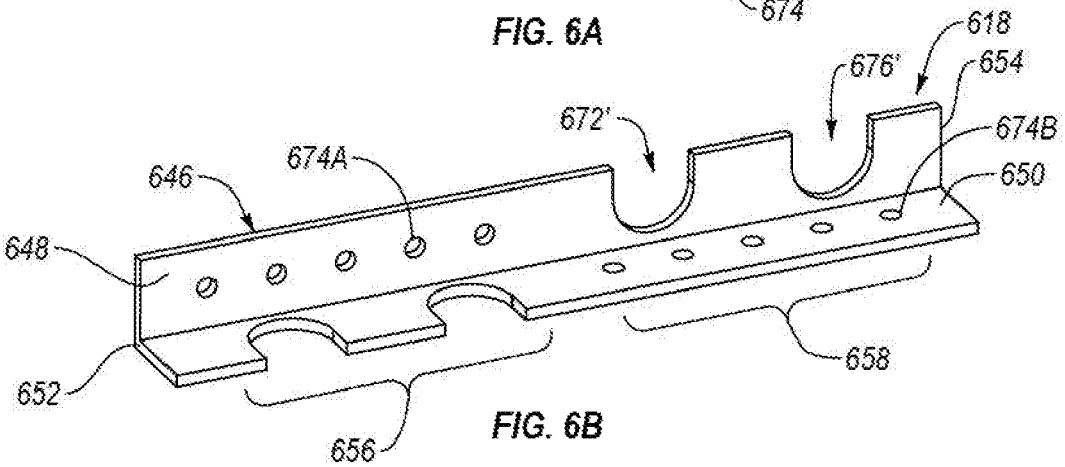
FIG. 6B is an isometric view of a connector that includes at least one structural fuse formed therein, according to an embodiment.

FIG. 6B is an isometric view of a connector 618 that includes at least one structural fuse 672' formed therein, according to an embodiment. The connector 618 may be substantially similar to any of the connectors described herein and may be used in any of the embodiment described herein. For example, the illustrated connector 618 may be an angle 646 that exhibits a generally L-shaped cross-section. Alternatively, the connector 618 may include a splice plate or another suitable connector. The illustrated connector 618 includes a first connector wall 648 and a second connector wall 650. The connector 618 may also include a first portion 656 that extends from a first connector end 652 to an intermediate location of the angle 646 and a second portion 658 that extends from the first portion 656 to a second connector end 654. The first portion 656 may be configured to be connected to an EDP (not shown). As such, the first connector wall 648 of the second portion 658 may define a plurality of first holes 674A that are configured to facilitate attachment of the connector 618 to the EDP using bolts, rivets, threaded fasteners, etc. However, the first holes 674A may be omitted and the angle 646 may be connected to the EDP using other attachment methods, such as welding. The second portion 658 may be configured to be connected to at least one connection surface of a beam (not shown). As such, the second connector wall 650 of the second portion 658 may define a plurality of second holes 674B that are configured to facilitate attachment of the connector 618 to the beam using bolts, rivets, threaded fasteners, etc.

The connector 618 may include at least one structural fuse 672' that is configured to dissipate seismic or other energy while maintaining the beam connected to the column. Similar to the EDP 616 shown in FIG. 6A, the at least one structural fuse 672' may be configured to preferentially yield a portion of the angle 646 that does not materially affect the connection between the connector and the beam.

In an embodiment, the structural fuse 672' may include two or more cutouts 676' formed in and at least partially defined by the connector 618. Similar to the cutouts 676 shown in FIG. 6A, the cutouts 676' may be configured to preferentially yield the connector 618 in a region of the connector 618 that is at and/or between adjacent cutouts 676'. As such, the cutouts 676' may be formed in the connectors 618 such that the first holes 674A and the second holes 674B are not located at, near, and/or between cutouts 676'. For example, the connector 618 may include two or more cutouts 676' formed in second connector wall 650 of the first portion 656. Additionally or alternatively, the connector 618 may include two or more cutouts 676' formed in the first connector wall 648 of the second portion 658. As such, if the connector 618 preferentially yields in a region thereof that is spaced from the first holes 674A and the second holes 674B and thereby does not materially affect the connection between the connector 618 and the EDP and the connection between the connector 618 and the beam.

The structural fuse 672 shown in FIG. 6A and the structural fuse 672' shown in FIG. 6B may be configured to facilitate repair of the EDP 616 and/or the connector 618, respective, if the component preferentially yields.

Figure 6C:
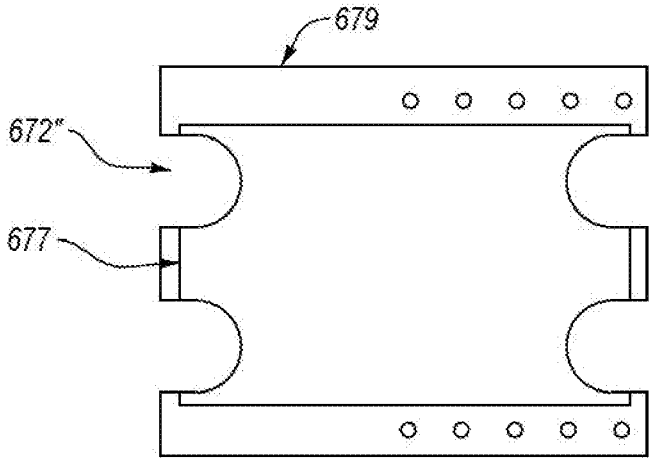
FIG. 6C is a side elevational view of a plate connected to a yielded component, according to an embodiment

FIG. 6C is a side elevational view of a plate 677 connected to a yielded component 679 (e.g., the EDP 616 or the connector 618), according to an embodiment. In an embodiment, the yielded component 679 may be repaired by connecting a plate 677 thereto. The plate 677 may exhibit a size and shape that at least substantially covers at least a portion the yielded component 679. For example, the yielded component 679 may include a structural fuse 672" (e.g., the structural fuse 672 and/or 672') configure to preferentially yield in a selected region of the yielded component 679 (e.g., between adjacent cutouts). As such, the plate 677 may exhibit a size and shape that is substantially similar to the preferentially yielded region of the yielded component 679. Additionally, the size and the shape of the plate 677 may be known before the yielded component 679 is exposed and/or examined (e.g., assuming each yielded component 679 is configured substantially the same). The plate 677 may be configured to support some of the load applied to the moment-resisting frame after the plate 677 is connected to the yielded component 679. The plate 677 may be connected to the yielded component 679 using bolts, rivets, threaded fasteners, welding, etc. In an embodiment, the plate 677 may include at least a portion of the structural fuse 672" (e.g., two or more cutouts) formed therein. In other embodiments, the structural fuse may be omitted from the plate 677.

In an embodiment, the yielded component may be repaired by replacing the component. For example, the yielded component that may be configured to be easily replaced. For example, the yielded component may be simply be detached from other yielded components of the moment-resisting frame to which the yielded component is connected (e.g., the EDP 616 may be detached from a column and a connector, and/or the connector 618 may be detached from an EDP and a beam). For example, bolts and threaded fasteners may be loosed and removed therefrom, rivets may be severed, and welded connections may be cut. Then a new component may be attached to the other components of the moment-resisting frame. The new component may be substantially similar to the yielded component. For example, the new component may include at least one structural fuse and/or the new component may be attached to the other components of the moment-resisting frame in substantially the same manner. However, the new component may be different from the yielded component. For example, the new component may not include a structural fuse, may include a different structural fuse, or may be attached to the other components of the moment-resisting frame in a different manner.

The structural fuses 672, 672', 672" may minimize the likelihood that the component yields at a location that may compromise the integrity of the moment-resisting frame and/or prevent easy repairs of the moment-resisting frame. For example, without the structural fuses 672, 672', 672", the moment-resisting frame may yield at or near the connections between the column and the EDP, the EDP and the connector, and/or the connector and the beam if the moment-resisting frame did not include structural fuses 672, 672', 672". Such yielding may cause catastrophic failure of the moment-resisting frame. In another example, the moment-resisting frame may yield such that the moment-resisting frame is not easily replaced. In particular, the column and/or the beam may yield.

Figure 7:
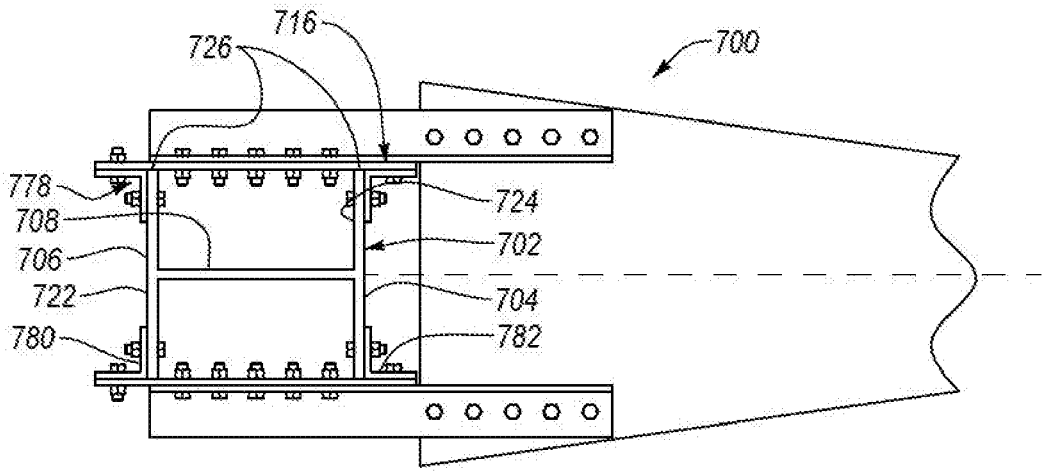
FIG. 7 is a top plan view illustrating a portion of a moment-resisting frame, according to an embodiment.

FIG. 7 is a top plan view illustrating a portion of a moment-resisting frame 700, according to an embodiment. The method of connecting the EDP 716 to the column 702 discussed in relation to FIG. 7 may be using in any of the moment-resisting frames disclosed herein.

The moment-resisting frame 700 may be substantially similar to the moment-resisting frame discussed in relation to FIGS. 1A-1C. For example, the moment-resisting frame 700 may include a column 702 that includes a first column flange 704, a second column flange 706, and a column web 708 attached to the first column flange 704 and the second column flange 706. Each of the first column flange 704 and the second column flange 706 may include an exterior column flange surface 722, an interior column flange surface 724, and two outer side surface 726 extending therebetween. The moment resisting-frame 700 may include a moment-resisting connection 714 that includes at least one EDP 716 indirectly connected to the column 702.

The moment-resisting frame 700 may include two or more doubler connectors 778 that are configured to be connected to the column 702 and the EDP 716. The doubler connectors 778 may include any device configured to be connected to the column 702 and the EDP 716. For example, the doubler connectors 778 may exhibit a generally L-shaped cross-section that includes a first doubler connector wall 780 and a second doubler connector wall 782 that extends (e.g., substantially perpendicularly) from the first doubler connector wall 780.

Each first doubler connector wall 780 may be configured to connect to the first column flange 704 and/or the second column flange 706. For example, the first doubler connector wall 780 may be positioned adjacent to the interior column flange surface 724 or the exterior column flange surface 722 when the first doubler connector wall 780 is connected to the first column flange 704 or the second column flange 706. The first doubler connector wall 780 may be connected to the first column flange 704 or the second column flange 706 using welding, bold, rivets, threaded fasteners, or another suitable method of attachment. For example, the first doubler connector wall 780 may define a plurality of holes formed therein (e.g., second holes 874B shown in FIG. 8) that are configured to facilitate attachment of the first doubler connector wall 780 to the column 702 using bolts, rivets, etc.

Each second doubler connector wall 782 may be configured to connect to an EDP 716. In an embodiment, the second doubler connector wall 782 may be connected to the EDP 716 using welding, rivets, or another suitable semi-permanent attachment method. In another embodiment, the second doubler connector wall 782 may be connected to the EDP 716 using bolts, threaded fasteners, or another suitable reversible attachment method. A reversible method of attachment may include any attachment method configured to enable attachment and detachment of the EDP 716 from the doubler connector 778 without damaging the doubler connector 778, the EDP 716, or the device connecting the doubler connector 778 to the EDP 716 (e.g., the bolt). For example, if the EDP 716 is damaged (e.g., from yielding and/or from structural fuses preferentially causing yielding in the EDP 716), the EDP 716 may be conveniently replaced by de-attaching the EDP 716 from the doubler connectors 778 and attaching a replacement EDP that is configured the same or differently. For example, the second doubler connector wall 782 may define a plurality of holes formed therein (e.g., third holes 874C shown in FIG. 8) that are configured to facilitate attachment of the second doubler connector wall 782 to the column 702.

The EDP 716 may define a plurality of first holes (e.g., fifth holes 874E shown in FIG. 8) configured to facilitate attachment of at least one connector (not shown) to the EDP 716. For example, the EDP 716 may define two or more sets of holes each of which is configured to attach to separate connectors. The EDP 716 may also define a plurality of holes (e.g., fourth holes 874D shown in FIG. 8) configured to facilitate attachment of the doubler connectors 778 to the EDP 716. For example, the EDP 716 may define two or more sets of holes each of which is configured to attach to separate doubler connectors 778.

Figure 8:
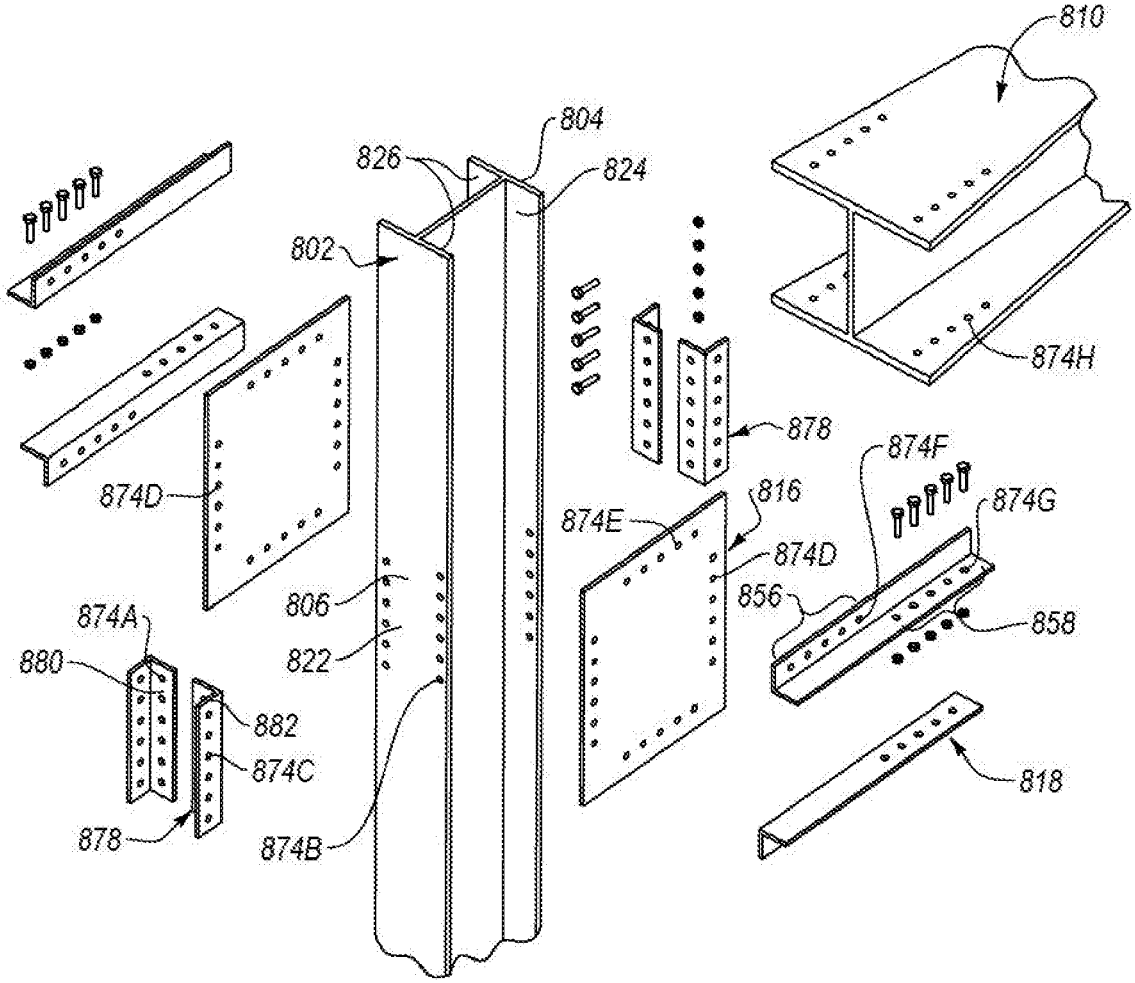
FIG. 8 is an exploded, isometric view of a kit used to form a moment-resisting connection, according to an embodiment.

FIG. 8 is an exploded, isometric view of a kit 884 used to form a moment-resisting connection, according to an embodiment. The kit 884 may be used to form a moment-resisting frame that is substantially similar to any of the moment-resisting frames described herein. For example, the kit 884 may be used to form a moment-resisting connection that connects, in part, to a column 802 that includes a first column flange 804 and a second column flange 806. Each of the first column flange 804 and the second column flange 806 may include an exterior column flange surface 822, an interior column flange surface 824, and two outer side surfaces 826. The kit 884 includes at least one EDP 816 that may be similar to or the same as any of the EDPs disclosed herein. For example, the EDP 816 may be configured to be positioned adjacent to one of the two outer side surfaces 826 of the first column flange 804 and one of the two outer side surfaces 826 of the second column flange 806. The kit 884 may include two or more doubler connectors 878 configured to connect the EDP 816 to the column 802. Each doubler connector 878 may include a first doubler connector wall 880 that is configured to be connected to the column 802 and a second doubler connector wall 882 that is configured to be connected to the EDP 816. Alternatively, the doubler connectors 878 may be omitted from the kit 884 and the EDP 816 may be configured to be directly connected to the column 802, for example, using welding. The kit 884 also includes two or more connectors 818 that are configured to be connected to the EDP 816 and a beam 810. The connectors 818 may be configured as any of the connectors disclosed herein. For example, each of the connectors 818 may include a first portion 856 configured to be connected to the EDP 816 and a second portion 858 that is configured to be connected to the beam.

In an embodiment, the kit 884 may be configured to be assembled and connected to the column 802 and the beam without welding. For example, the kit 884 may be configured to be assembled and connected to the column 802 and the beam 810 using bolts, rivets, threaded fasteners, etc. For example, the first doubler connector wall 880 may define a plurality of first holes 874A. The first holes 874A may correspond to a plurality of second holes 874B defined by the first column flange 804 and/or the second column flange 806. The first holes 874A and the second holes 874B may facilitate attachment of the doubler connector 878 to the column 802. In an embodiment, the second doubler connector wall 882 may define a plurality of third holes 874C. The third holes 874C may correspond to a plurality of fourth holes 874D defined by the EDP 816. The third holes 874C and the fourth holes 874D may facilitate attachment of the doubler connector 878 to the EDP 816. In an embodiment, the EDP 816 may define a plurality of fifth holes 874E. The fifth holes 874E may correspond to a plurality of sixth holes 874F defined by the first portion 856 of the connector 818. The fifth holes 874E and the sixth holes 874F may facilitate attachment of the connector 818 to the EDP 816. In an embodiment, the second portion 858 of the connector 818 may define a plurality of seventh holes 874G. The seventh holes 874G may correspond to a plurality of eighth holes 874H defined by the beam 810. The seventh holes 874G and the eighth holes 874H may facilitate attachment of the connector 818 to the beam 810. The kit 884 may also include a plurality of at least one of a plurality of bolts, rivets, threaded fasteners, etc. configured to assemble the moment-resisting connection and connect the moment-resisting connection to the column 802 and the beam.

In an embodiment, one or more components of the kit 884 may not define a plurality of holes. In such an embodiment, the one or more components of the kit 884 that do not define a plurality of holes may be connected to other components of the kit 884 using welding or another suitable attachment method. For example, the doubler connectors 878 may not define the first holes 874A and/or the column 802 may not define the second holes 874B. As such, the doubler connectors 878 and the column 802 may be connected using welding.

In an embodiment, the kit 884 may include one or more components of the moment-resisting frame connected to each other (e.g., connected off-site). For example, the kit 884 may include at least one EDP 816 having at least one connector 818 connected thereto, a column 802 having at least one EDP 816 connected thereto, at least one EDP 816 having at least one doubler connector 878 connected thereto, a beam 810 having at least one connector 818 connected thereto, a column 802 having at least one doubler connector 878 connected thereto, or a combination thereof.

Figure 9:
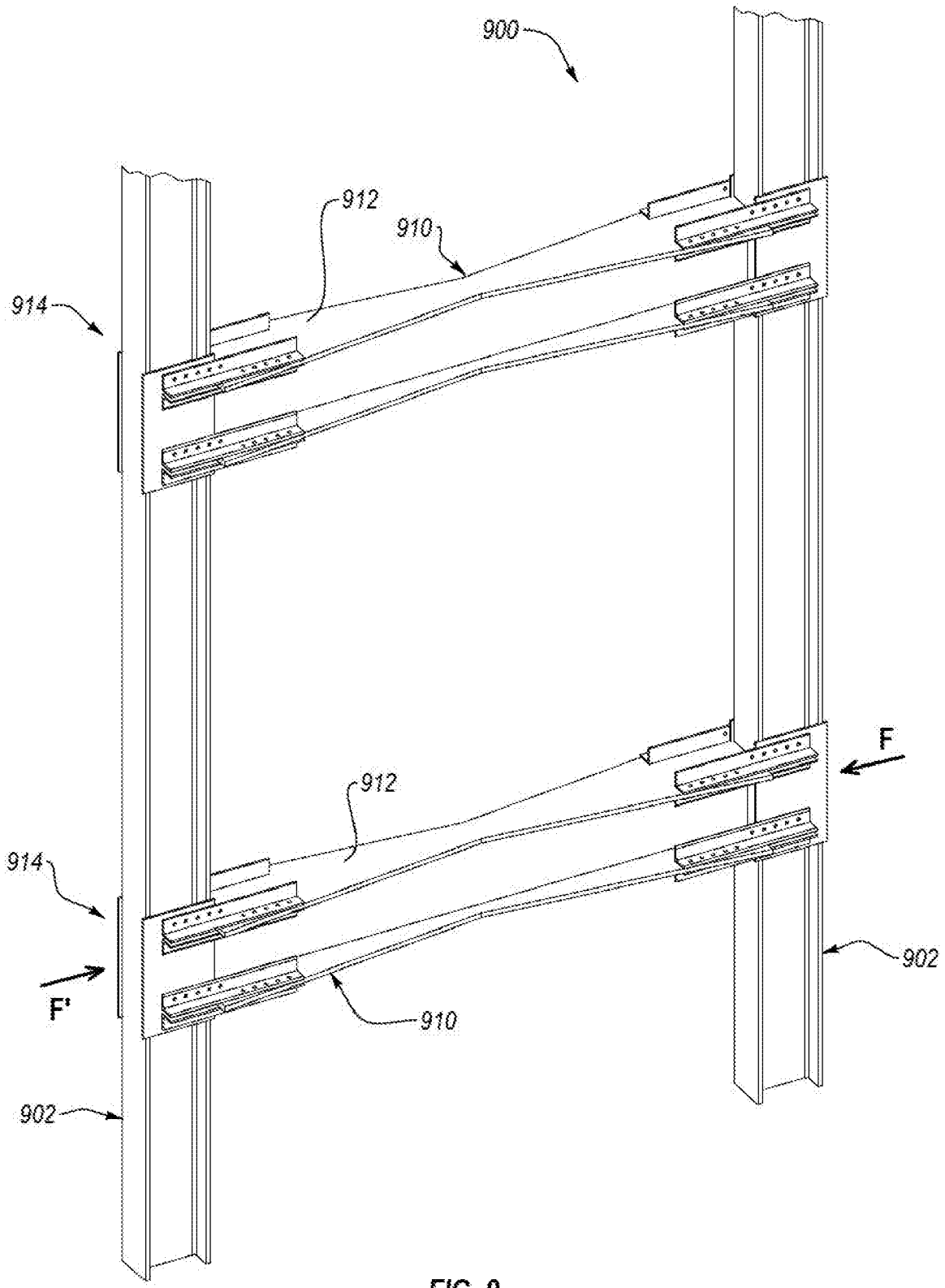
FIG. 9 is an isometric view of a moment-resisting frame, according to an embodiment.

FIG. 9 is an isometric view of a moment-resisting frame 900, according to an embodiment. The moment-resisting frame 900 may include one or more horizontally oriented beams 910 connected to and extending between opposing vertical columns 902. Each beam 910 may be connected to one of the columns 902 using a moment-resisting connection 914. The moment-resisting connection 914 may include any of the moment-resisting connections disclosed herein. For example, the moment-resisting connection 914 may include at least one EDP 916 connected to the column 902. The moment-resisting connection 914 may also include two or more connectors 918 that are connected to the EDP 916 and at least one connection surface 912 of the beam 910. In an embodiment, the moment-resisting connection 914 may form a rigid connection between the column 902 and the beam 910.

In an embodiment, application of a lateral force F or F' to the moment-resisting frame 900 may produce bending and/or twisting (e.g., elastic or plastic deformation) to the beams 910. The lateral force F or F' may be applied to the moment-resisting frame 900 due to one or more of seismic activity, a wind loading event, or some other cause. The moment-resisting connection 914 may hold the beams 910 and the columns 902 together while the lateral force F or F' are applied to the moment-resisting frame. Moreover, in some embodiments, each of the columns 902 may include a single continuous beam or multiple beams connected together (e.g., welded, fastened together, etc.)

While various aspects and embodiments have been disclosed herein, other aspects and embodiments are contemplated. The various aspects and embodiment disclosed herein are for purposes of illustration and are not intended to be limiting.

The invention claimed is:

1. A moment-resisting frame, comprising:

a column defining a column longitudinal axis, the column including a first lateral member and a second lateral member spaced from and opposing the first lateral member, the first lateral member and the second lateral member extending along the column longitudinal axis;

a beam defining a beam longitudinal axis, the beam including a top beam flange and a bottom beam flange, the top beam flange and the bottom beam flange extending along the beam longitudinal axis; and two or more connectors, each of the two or more connectors including a connector wall that is generally planar and generally parallel to the top beam flange and the bottom beam flange, the connector wall including:

a first portion that is coupled to the column and positioned adjacent to at least one of the first lateral member of the column or the second lateral member of the column; and a second portion that is coupled to one of the top beam flange or the bottom beam flange.

2. The moment-resisting frame of claim 1, wherein the column includes a fore member and an aft member spaced from and opposing the fore member, the fore member and the aft member extending between and coupled to the first lateral member and the second lateral member.

3. The moment-resisting frame of claim 1, wherein the first and second lateral members define respective flanges, and wherein the column includes a web extending between the two flanges.

4. The moment-resisting frame of claim 1, wherein the first portion of the connector wall is positioned adjacent to both of the first lateral member and the second lateral member.

5. The moment-resisting frame of claim 1, wherein the beam exhibits a width that gradually decreases along the longitudinal axis from a first location to a second location spaced further from the column than the first location.

6. The moment-resisting frame of claim 1, wherein the beam exhibits a substantially uniform width.

7. The moment-resisting frame of claim 1, wherein at least one of the two or more connectors includes an angle having an additional connector wall extending generally perpendicularly from the connector wall.

8. The moment-resisting frame of claim 1, wherein at least one of the two or more connectors includes a splice plate that is substantially planar.

9. The moment-resisting frame of claim 1, wherein each of the two or more connectors defines at least one cutout that is configured to accommodate at least a portion of the column therein.

10. The moment-resisting frame of claim 1, wherein the two or more connectors extend longitudinally in a direction that is generally parallel to the longitudinal axis of the beam.

11. The moment-resisting frame of claim 1, further comprising at least one plate coupled to at least one of the top beam flange or the bottom beam flange.

12. The moment-resisting frame of claim 10, wherein the second portion of the two or more connectors are coupled indirectly to the beam via the at least one plate.

13. The moment-resisting frame of claim 1, further comprising two exterior doubler plates, each of the two exterior doubler plates including an interior doubler surface and an exterior doubler surface, the interior doubler surfaces of the two exterior doubler plates positioned adjacent to the first lateral member and the second lateral member, the two exterior doubler plates connected to the column, wherein the two exterior doubler plates do not enclose any portion of the beam;

wherein the two or more connectors are coupled to the column indirectly via the two exterior doubler plates.

14. The moment-resisting frame of claim 1 wherein one or more of at least one of the two exterior doubler plates or the two or more connectors includes at least one structural fuse positioned and configured to preferentially yield.

15. A kit for assembling a moment-resisting frame, the moment-resisting frame including:

a column including a first lateral member and a second lateral member spaced from and opposing the first lateral member, the first lateral member and the second lateral member extending along a column longitudinal axis of the column; and a beam including a top beam flange and a bottom beam flange, the top beam flange and the bottom beam flange extending along a beam longitudinal axis of the beam; and the kit comprising two or more connectors, each of the two or more connectors including a connector wall that is generally planar and generally parallel to the top beam flange and the bottom beam flange, the connector wall including:

a first portion that is coupled to the column and positioned adjacent to at least one of the first lateral member of the column or the second lateral member of the column; and a second portion that is coupled to one of the top beam flange or the bottom beam flange.

16. The kit of claim 15, further comprising two exterior doubler plates, each of the two exterior doubler plates including:

an interior doubler surface exhibiting a width that is sufficient to be positioned adjacent to the first lateral member and the second lateral member; and an exterior doubler surface spaced from the interior doubler surface;

wherein the column, the beam, and the two exterior doubler plates are configured such that, when the two or more connectors are connected to the beam and the two exterior doubler plates, and when each of the two exterior doubler plates is mounted to the column, each of the two exterior doubler plates do not enclose any portion of the sides of the beam.

17. The kit of claim 15, wherein the two or more connectors define at least one cutout that is configured to accommodate at least a portion of the column therein.

18. The kit of claim 15, wherein at least one of the two or more connectors includes an angle having an additional connector wall extending generally perpendicularly from the connector wall.

19. The kit of claim 15, wherein at least one of the two or more connectors includes a splice plate.

20. The kit of claim 15, wherein one or more of at least one exterior doubler plate coupled to the column or the two or more connectors includes at least one structural fuse.

* * * * *